US010297947B2

(12) United States Patent
Frey et al.

(10) Patent No.: US 10,297,947 B2
(45) Date of Patent: May 21, 2019

(54) GAS RESISTANT POTHEAD SYSTEM AND METHOD FOR ELECTRIC SUBMERSIBLE MOTORS

(71) Applicant: Summit ESP, LLC, Tulsa, OK (US)

(72) Inventors: Jeffrey G. Frey, Broken Arrow, OK (US); Terry L. Glasscock, Vinita, OK (US); Gregory Austin Davis, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/716,362

(22) Filed: Sep. 26, 2017

(65) Prior Publication Data

US 2018/0090874 A1 Mar. 29, 2018

Related U.S. Application Data

(60) Provisional application No. 62/400,204, filed on Sep. 27, 2016.

(51) Int. Cl.
*H01R 13/523* (2006.01)
*H01B 7/04* (2006.01)
(Continued)

(52) U.S. Cl.
CPC ..... *H01R 13/523* (2013.01); *E21B 17/028* (2013.01); *H01B 7/046* (2013.01);
(Continued)

(58) Field of Classification Search
CPC ..... H01R 13/523; H01R 13/5221; H01R 13/5205; E21B 17/028; E21B 43/128; H01B 7/046
(Continued)

(56) References Cited

U.S. PATENT DOCUMENTS 2,827,508 A * 3/1958 Roehmann ..... H02G 15/068 174/73.1
4,679,875 A * 7/1987 Ramsey ..... H01R 13/523 439/276
(Continued)

FOREIGN PATENT DOCUMENTS

WO 2015120357 A1 8/2015

OTHER PUBLICATIONS

International Searching Authority, "International Search Report and Written Opinion of the International Searching Authority" for PCT Application No. PCT/US2017/053545, dated Jan. 11, 2018, 16 pages.

*Primary Examiner* — Felix O Figueroa
(74) *Attorney, Agent, or Firm* — Gilliam IP PLLC

(57) ABSTRACT

A gas resistant pothead system and method for electric submersible motors. A gas resistant pothead system includes a lead foil wrapped motor lead cable (MLE) extending through a pothead, a sleeve of an insulator block inside the pothead, the sleeve including gold plating and lead-foil wrapping over the gold plating, and a lead-to-gold seal formed between the gold plating of the sleeve and the lead foil wrapping over the gold plating. A method of creating a seal to gas around a power cable connection to a downhole electric submersible motor includes wrapping lead foil around a MLE extending through a pothead, continuing the lead foil wrapping around a gold-plated sleeve of an insulating block inside the pothead, mechanically reinforcing the lead foil with an encapsulant, and bonding the lead foil to the gold plating of the insulating block.

12 Claims, 7 Drawing Sheets

(51) Int. Cl.

| | |
|---|---|
| ***H01B 7/28*** | (2006.01) |
| ***H01R 13/52*** | (2006.01) |
| ***H01R 43/00*** | (2006.01) |
| ***E21B 17/02*** | (2006.01) |
| *E21B 43/12* | (2006.01) |

(52) U.S. Cl.
CPC ..... *H01B 7/2813* (2013.01); *H01R 13/5205* (2013.01); *H01R 13/5221* (2013.01); *H01R 43/005* (2013.01); *E21B 43/128* (2013.01)

(58) Field of Classification Search
USPC ..... 439/276, 936
See application file for complete search history.

(56) References Cited

U.S. PATENT DOCUMENTS

| | | | | |
|---|---|---|---|---|
| 5,700,161 | A | 12/1997 | Plummer et al. | |
| 6,361,342 | B1 | 3/2002 | Cox | |
| 6,676,447 | B1 | 1/2004 | Knox | |
| 7,942,696 | B2 * | 5/2011 | Watson | H01R 13/5216 439/589 |
| 8,512,074 | B2 | 8/2013 | Frey | |
| 8,766,110 | B2 * | 7/2014 | Daughtry | H02G 3/0691 174/650 |
| 9,470,216 | B2 * | 10/2016 | Reeves | F04B 17/03 |
| 2009/0269956 | A1 | 10/2009 | Frey et al. | |
| 2012/0052721 | A1 | 3/2012 | Watson | |
| 2014/0147301 | A1 | 5/2014 | Reeves et al. | |

* cited by examiner

GAS RESISTANT POTHEAD SYSTEM AND METHOD FOR ELECTRIC SUBMERSIBLE MOTORS

CROSS REFERENCE TO RELATED APPLICATIONS

This application claims the benefit of U.S. Provisional Application No. 62/400,204 to Frey et al., filed Sep. 27, 2016 and entitled "ELECTRIC SUBMERSIBLE MOTOR POTHEAD SYSTEM AND APPARATUS," which is hereby incorporated by reference in its entirety.

BACKGROUND OF THE INVENTION

1. Field of the Invention

Embodiments of the invention described herein pertain to the field of electric submersible motor power cable connections. More particularly, but not by way of limitation, one or more embodiments of the invention enable a gas resistant pothead system and method for electric submersible motors.

2. Description of the Related Art

Fluid, such as natural gas, oil or water, is often located in underground formations. When pressure within the well is not enough to force fluid out of the well, the fluid must be pumped to the surface so that it can be collected, separated, refined, distributed and/or sold. Centrifugal pumps are typically used in electric submersible pump (ESP) applications for lifting well fluid to the surface. Centrifugal pumps impart energy to a fluid by accelerating the fluid through a rotating impeller paired with a stationary diffuser. A rotating shaft runs through the central hub of the impeller, and the impeller is keyed to the shaft such that the impeller rotates with the shaft. A motor below the pump turns the shaft. In ESP assemblies, the multistage centrifugal pump is included in an ESP system that includes an ESP motor, seal section and intake below the pump, and production tubing above the pump.

The shaft's rotation is powered by an electric motor located on the upstream side of the pump assembly, and is typically a two-pole, three-phase squirrel cage induction motor. The ESP power source is located at the wellhead and is connected to the motor by insulated, electrical conductors, which extend alongside the ESP assembly down into the wellbore. The motor lead extension (MLE) cable, also referred to as the motor flat, is a low-profile, flat cable that is spliced to the lower end of the main power cable, banded to the side of the ESP pump and seal-chamber section, and has the male termination for plugging or splicing into the motor electrical connection. At the connection point to the motor, the MLE extends through a protected electrical connector that engages with an electrical receptacle on the motor. The electrical connector is sometimes referred to in the art as a "pothead," named after the potted or encapsulated conductors inside the electrical connector. The conventional pothead includes a corrosion-resistant steel body and elastomeric insulating material used within the body that attempts to seal and insulate the electrical connections. Elastomers such as rubber, polypropylene, polyethylene or PolyEther Ether Ketone (PEEK) are commonly used as the material to insulate the motor's electrical connections. Elastomeric rings inside the pothead may also provide a seal by compressing the insulating material against the electrical conductors contained within the conventional pothead.

A problem that arises is that, the downhole ESP assembly may be exposed to gas that damages the encapsulation, elastomeric and sealing components of the pothead. ESP assemblies are often utilized in harsh underground environments with high gas content having gas-to-liquid ratios (GLR) of up to 30%. Damaging gas such as methane, hydrogen sulfide ($H_2S$), and carbon dioxide ($CO_2$) are found in some underground formations and can permeate the encapsulation materials inside the conventional pothead. The gas causes the insulating and sealing elements of the conventional pothead to decompress and delaminate, causing a loss of their insulating and sealing benefits. For example, sour gas can cause a gas decompression event including loss of the pressure seal and delamination of the power cable insulation, which can lead to shorts in the MLE. Once the gases are inside the pothead body, the gas penetrates and attacks the cable and motor conductors and can even contaminate the motor oil, leading to motor failure and shortening the operational lifetime of the pump. Submersible motor components are especially difficult to repair or replace since the motor assembly is often located deep underground, sometimes thousands of feet deep.

Since lead is known to be impermeable to gas such as $H_2S$ and $CO_2$, attempts have been made to employ a lead solder within the pothead housing, with the aim of sealing the lead solder to the lead sheath of the MLE cable as well as the inner diameter of the pothead housing. The problem with using lead solder is that the lead solder melts at around 377° F., lower than the operating conditions experienced by the downhole ESP motor, which can be as high as 450° F. Higher temperature solders do not solve the problem because they cannot bond to the lead sheath of the cable, since the lead sheath itself melts and also terminates inside the pothead. Use of lead solder also requires a skilled artist to manufacture the pothead, and even then, there is a high manufacturing defect rate.

As is apparent from the above, current electrical submersible motor pothead connections are not suitable for gaseous, high temperature downhole conditions experienced by ESP motors. Therefore, there is a need for a gas resistant pothead system and method for electric submersible motors.

BRIEF SUMMARY OF THE INVENTION

One or more embodiments of the invention enable a gas resistant pothead system and method for electric submersible motors.

A gas resistant pothead system and method for electric submersible motors is described. An illustrative embodiment of a gas resistant pothead system includes a pothead for a motor lead extension (MLE) of an electric submersible motor power cable, the pothead including a pothead cavity above an insulator block, the insulator block gold plated and including a gold-plated sleeve extending into the cavity, the MLE extending through the pothead cavity and the gold-plated sleeve of the insulator block, a lead seal inside the pothead cavity, the lead seal resistant to sour gas and including lead foil wrapped around the gold-plated sleeve of the insulator block and around the MLE inside the pothead cavity, the lead foil bonded to the gold plating on the gold-plated sleeve of the insulator block, and an encapsulant within the pothead cavity surrounding the lead foil wrapped MLE, wherein the lead seal resists penetration of the sour gas into the insulator block. In some embodiments, the pothead cavity is formed by a pothead base coupled below a pothead cap, and the pothead base includes a second gold plating. In certain embodiments, the gas resistant pothead system further includes a lead gasket secured around an inner diameter of the pothead base, the lead gasket bonded to the gold plating on the insulator block and the second gold plating on the pothead base. In some embodiments, the lead gasket is between the insulator block and a second insulator block below the first insulator block. In certain embodiments, the lead foil wraps around the MLE from above a termination point of an MLE lead sheath to an intersection of the MLE with the insulator block. In some embodiments, the lead foil continues to wrap around the sleeve of the insulator block below the intersection of the MLE with the insulator block. In certain embodiments, multiple layers of the lead foil form the lead seal. In some embodiments, the lead foil wraps around one of MLE lead sheath, MLE insulation, or a combination thereof. In certain embodiments, the MLE includes an inner copper conductor, an insulation layer around the inner copper conductor, an extruded lead sheath around the insulation layer, the extruded lead sheath terminating inside the pothead cavity, and armor around the extruded lead sheath, the armor terminating inside the pothead cavity above termination of the extruded lead sheath. In some embodiments, the lead foil wraps around the extruded lead sheath and then continues around the gold-plated sleeve of the insulator block. In certain embodiments, the lead foil wraps around the insulation layer and then continues around the gold-plated sleeve of the insulator block.

An illustrative embodiment of a method of creating a seal to gas around a power cable connection to a downhole electric submersible motor includes wrapping lead foil around a motor lead cable extending through a pothead, continuing the lead foil wrapping around an outer diameter of a sleeve of an insulating block inside the pothead, the motor lead cable extending through the sleeve of the insulating block, mechanically reinforcing the lead foil wrapping with an encapsulant that holds the lead foil in place around the motor lead cable inside the pothead, gold plating the pothead body and the insulating block inside the pothead body, and bonding the lead foil to the gold plating of the insulating block. In some embodiments, the method further includes powering the downhole electric submersible motor with the wrapped, encapsulated motor lead cable to operate the downhole electric submersible motor in a well including sour gas. In some embodiments, the well reaches a temperature of 450° F. during operation of the downhole electric submersible motor and the seal to gas remains resistant to the sour gas at the 450° F. temperature. In certain embodiments, the method further includes stretching polytetrafluoroethylene (PTFE) splice tape around the lead foil wrapping. In some embodiments, the lead foil is wrapped around an insulating layer of the motor lead cable. In certain embodiments, the insulating block includes corrosion resistant steel, and gold plating the insulating block further includes covering the insulating block with a thin layer of fourteen karat gold. In some embodiments, wrapping the lead foil around the motor lead cable includes rolling lead foil tape a half-inch wide and 0.030 inches thick around the motor lead cable.

An illustrative embodiment of a gas resistant pothead system includes a pothead electrically coupling a motor lead extension (MLE) to an electric submersible motor, the pothead including a hollow gold-plated base, a hollow cap coupled above the gold-plated base, an insulator block including gold plating and at least one gold plated sleeve, the insulator block inside the gold-plated hollow base, and the MLE including at least one MLE phase extending through a cavity of the hollow cap and through the at least one gold plated sleeve of the gold-plated insulator block, the MLE including a lead sheath that terminates inside the hollow cap, lead foil wrapped around a portion of an outer surface of each of the at least one MLE phase, the lead foil wrapped portion extending between the termination of the lead sheath and an MLE phase entrance to the gold-plated sleeve, the lead foil wrap continuing around the gold-plated sleeve, and encapsulant filling the cavity of the hollow cap and reinforceably surrounding the lead foil wrapped portion of the at least one MLE phase. In some embodiments, each of the at least one MLE phase includes a copper conductor, an insulation layer around the copper conductor, and an extruded lead sheath around the insulation layer, wherein the lead foil wraps around one of the insulation layer, the extruded lead sheath or a combination thereof. In some embodiments, polytetrafluoroethylene (PTFE) tape wraps around the lead foil wrap. In certain embodiments, the electric submersible motor is downhole in an underground formation and the MLE is coupled to a power cable extending between the MLE and a power source at a surface of the underground formation. In some embodiments, the gold plating of the sleeve is bonded to the lead foil. In certain embodiments, the insulator block is corrosion resistant steel and the gold plating is plated over the corrosion resistant steel. In some embodiments, the encapsulant includes one of lead solder, epoxy, high-temperature ceramic or a combination thereof and provides mechanical integrity to keep the lead foil in place around the at least one MLE phase. In certain embodiments, the gas resistant pothead system further includes a lead gasket extending around an inner diameter of the gold-plated hollow base below the insulator block, the lead gasket bonded to the gold plating of the hollow base and the gold plating of the insulator block. In some embodiments, the lead gasket is sandwiched between the insulator block and a second insulator block positioned below the insulator block. In certain embodiments, layers of lead foil overlap around each of the at least one MLE phase. In some embodiments, the lead foil is at least 99% pure lead. In certain embodiments, the electric submersible motor is a two-pole, three-phase squirrel cage induction motor operatively coupled to a multi-stage centrifugal pump.

An illustrative embodiment of a gas resistant pothead system includes a lead foil wrapped motor lead cable extending through a pothead, a sleeve of an insulator block inside the pothead, the sleeve including gold plating and lead-foil wrapping over the gold plating, and a lead-to-gold seal formed between the gold plating of the sleeve and the lead foil wrapping over the gold plating. In some embodiments the gas resistant pothead system further includes a gold-plated housing surrounding the insulator block inside the pothead, and a lead gasket secured to an inner diameter of the gold-plated housing and positioned below and adjacent to the insulator block.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
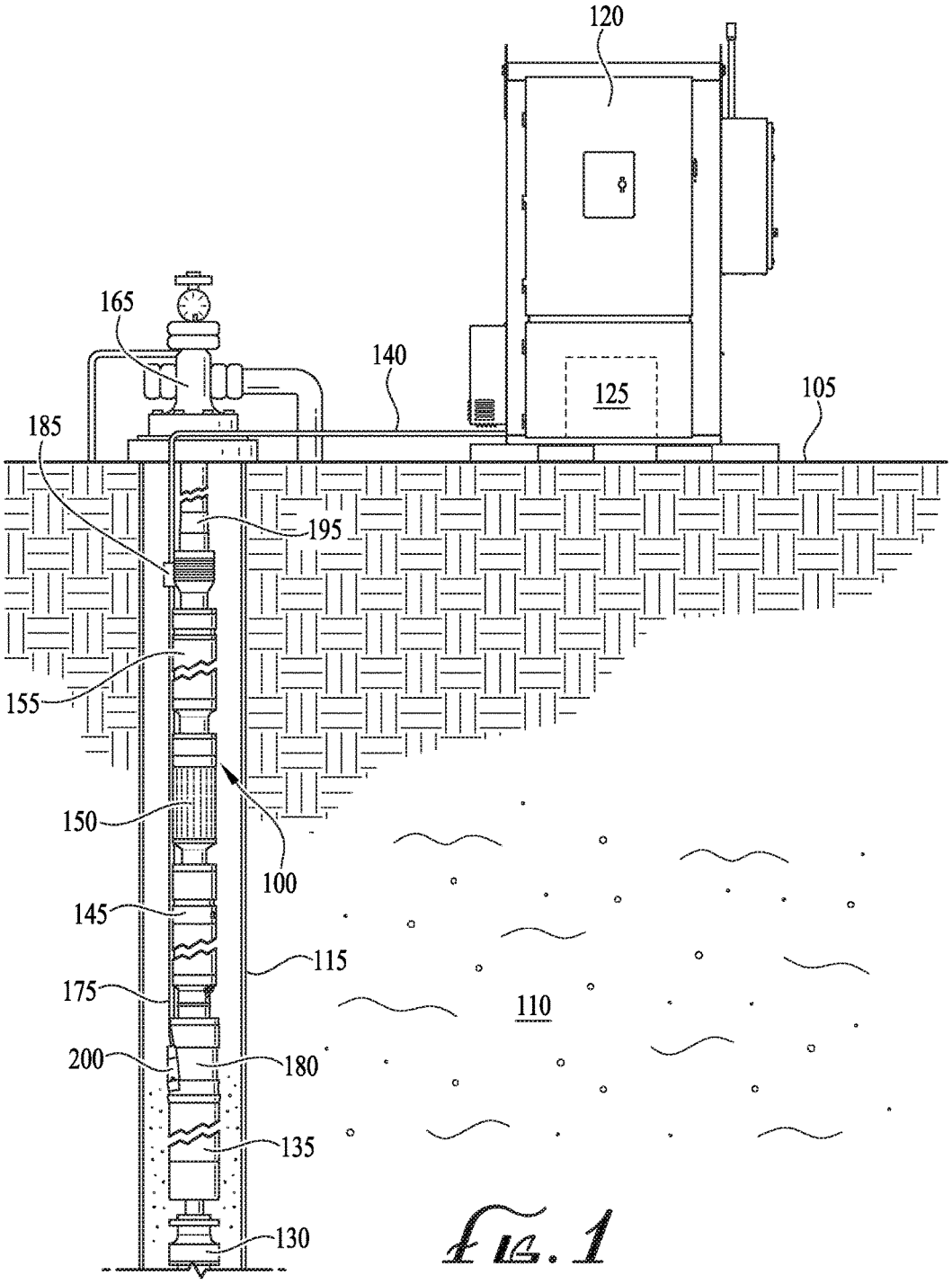
FIG. 1 is a perspective view of an electric submersible pump (ESP) assembly employing a pothead of an illustrative embodiment.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

A gas resistant pothead system and method for electric submersible motors is described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a phase includes one or more phases.

As used in this specification and the appended claims, "coupled" refers to either a direct connection or an indirect connection (e.g., at least one intervening connection) between one or more objects or components. The phrase "directly attached" means a direct connection between objects or components.

As used in this specification and the appended claims, "above" refers to the direction in a downhole well towards the surface of the well, without regard to whether the well is vertical, horizontal or extends through a radius.

As used in this specification and the appended claims, "below" refers to the direction in a downhole well away from the surface of the well, without regard to whether the well is vertical, horizontal or extends through a radius.

As used in this specification and the appended claims, "insulator block" or "insulating block" refer interchangeably to a block inside a pothead housing, such as the pothead base, which block surrounds the electrical connections inside the pothead. Although conventionally the "insulator block" or "insulating block" would have been made of an insulating material such as rubber or polyether ether ketone (PEEK), illustrative embodiments are not so limited and include an insulator block or insulating block made of corrosion resistant steel or another similar material without insulating properties.

For ease of description, the illustrative embodiments described herein are described in terms of an electric submersible pump (ESP) assembly operating in a downhole oil or gas well. However, the pothead system of illustrative embodiments may be applied to any motor exposed to damaging gas and having a motor electrical connection, such as plug-in, splice-in or tape-in. For example, the pothead of illustrative embodiments may be applied to submersible motors in axial-flow pumps, radial-flow pumps, mixed-flow pumps, horizontal surface pumps, and/or turbine regenerative type pumps.

Illustrative embodiments may provide a pothead electrical connector resistant to penetration from damaging gas present in downhole oil and gas wells, in particular sour gas ($H_2S$), carbon dioxide and methane, and may prevent the gas from damaging the electrical connections inside the pothead. Illustrative embodiments may provide a lead seal that retains its mechanical reinforcement, insulating and sealing capabilities in gaseous environments (such as up to 30% gas to liquid ratio) and temperatures up to 450° F. Illustrative embodiments may prevent gas from penetrating and attacking the power cable's motor lead extension (MLE) and motor conductors within the pothead, may prevent elastomeric decompression and delamination, and may prevent deformation of the pothead's encapsulation material. Illustrative embodiments may provide a sealed pothead connection despite high gas content such as 2%-30% gas-to-liquid ratio (GLR) or more, and/or high operating temperatures, such as 450° F. or about 450° F. The lead seal of illustrative embodiments may be employed in new pothead implementations or previously employed potheads may be retrofit with one or more features of illustrative embodiments, increasing efficiency and run life of an electric submersible motor.

The pothead of illustrative embodiments may seal a motor lead extension (MLE) extending through a pothead with lead foil. The lead foil may continue the non-pervious barrier from the lead sheathing of the cable to the upper insulator in the pothead, without the need for "potted" lead solder. Lead foil may be wrapped around the extruded lead of the MLE cable inside the pothead, and continue around the MLE cable insulation and/or down to the upper insulator block. The insulator block may be gold-plated and include sleeves that extend around the MLE cable at the insertion point of the MLE into the insulator block. The lead foil wrapping may continue from around the MLE cable phases around the gold-plated sleeves, and a gold-to-lead seal may form between the gold plating around the sleeve and the lead foil. PTFE splice tape may be applied over the lead foil to provide inward compression of the foil and permit diffusion bonding between the lead and gold. The inner diameter of the pothead base, as well as the outer diameter of the upper insulator may be gold plated to provide a gold-to-lead bond with the lead foil and/or a lead gasket. Lead solder, epoxy, rubber, high temperature potable ceramic, high temperature thermoplastic solder or any other potable encapsulant may fill the pothead cavity between the wrapped MLE cable and pothead base and cap and/or pothead housing, which may mechanically reinforce the lead foil to combat the low hoop strength of the lead foil. Rather than a plastic such as PEEK, the upper insulator may be made of corrosion resistant steel and gold plated. Use of metal for the upper insulator may reduce the ability of harmful gas to migrate through the pothead of illustrative embodiments. The lead gasket may be placed below the upper insulator block, between the upper and lower insulating blocks and may also bond to the gold plated pothead base and/or the gold-plated insulating block.

FIG. 1 is an illustrative embodiment of an electric submersible pump (ESP) assembly with a gas resistant pothead of an illustrative embodiment. ESP assembly 100 may be located downhole in a well below surface 105. The well may, for example, be several hundred or a few thousand feet deep. ESP assembly 100 may be vertical, horizontal or may be curved, bent and/or angled, depending on well direction. The well may be an oil well, water well, and/or well containing other hydrocarbons, such as natural gas, and/or another production fluid. Underground formation 110 may also contain damaging gas such as $H_2S$, methane and/or $CO_2$, which gas may constitute up to 30% or more of fluid lifted by the pump. ESP assembly 100 may be separated from underground formation 110 by well casing 115. In an exemplary embodiment, casing 115 may be about seven inches in diameter. Production fluid may enter well casing 115 through casing perforations (not shown). Casing perforations may be either above or below ESP intake 150.

ESP assembly may include, from bottom to top, downhole sensors 130 which may detect and provide information such motor speed, internal motor temperature, pump discharge pressure, downhole flow rate and/or other operating conditions to a user interface, variable speed drive controller and/or data collection computer on surface 105. ESP motor 135 may be an induction motor, such as a two-pole, three phase squirrel cage induction motor. Power cable 140 may provide power to ESP motor 135 and/or carry data from downhole sensors 130 to surface 105. ESP cabinet 120 at surface 105 may contain a power source 125 to which power cable 140 connects. Downstream of motor 135 may be motor protector 145, ESP intake 150, multi-stage centrifugal ESP pump 155 and production tubing 195. Motor protector 145 may serve to equalize pressure and keep the motor oil separate from well fluid. ESP intake 150 may include intake ports and/or a slotted screen, and serve as the intake to centrifugal ESP pump 155. ESP pump 155 may be a multi-stage centrifugal pump including stacked impeller and diffuser stages. Other components of ESP assemblies may also be included in ESP assembly 100, such as a tandem charge pump (not shown) or gas separator (not shown) located between centrifugal ESP pump 155 and intake 150 and/or a gas separator may serve as the pump intake. Shafts of motor 135, motor protector 145, ESP intake 150 and ESP pump 155 may be connected together (i.e., splined) and be rotated by shaft of motor 135. Production tubing 195 may carry working fluid 120 from the discharge of ESP pump 155 towards wellhead 165.

Power cable 140 may extend from power source 125 at surface 105 to motor lead extension (MLE) 175. Cable connection 185 may connect power cable 140 to MLE 175. MLE 175 may plug in, tape in, spline in or otherwise electrically connect power cable 140 to motor 135 to provide power to motor 135. Pothead 200 may enclose the electrical connection between MLE 175 and head 180 of motor 135.

Figure 2:
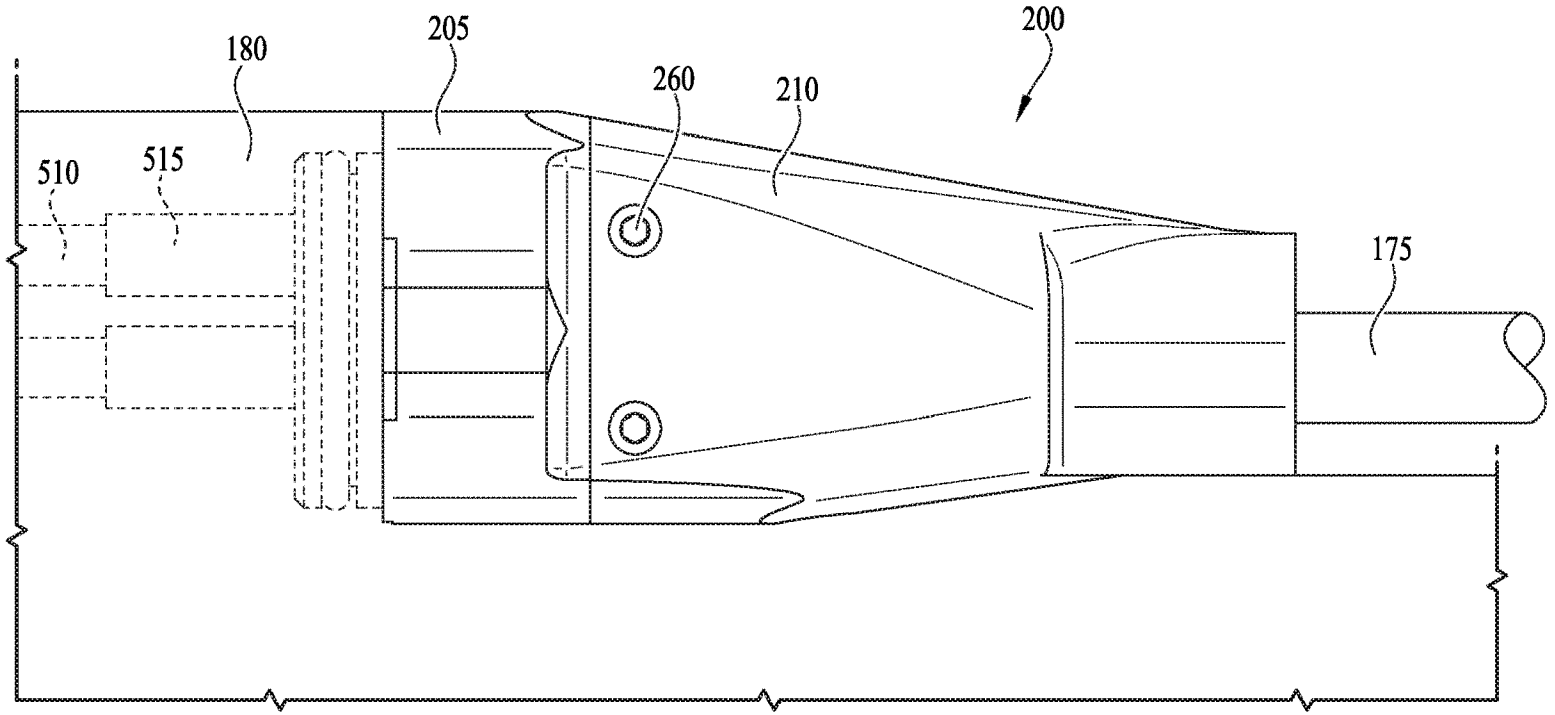
FIG. 2 is a perspective view of a pothead of an illustrative embodiment.
Figure 3:
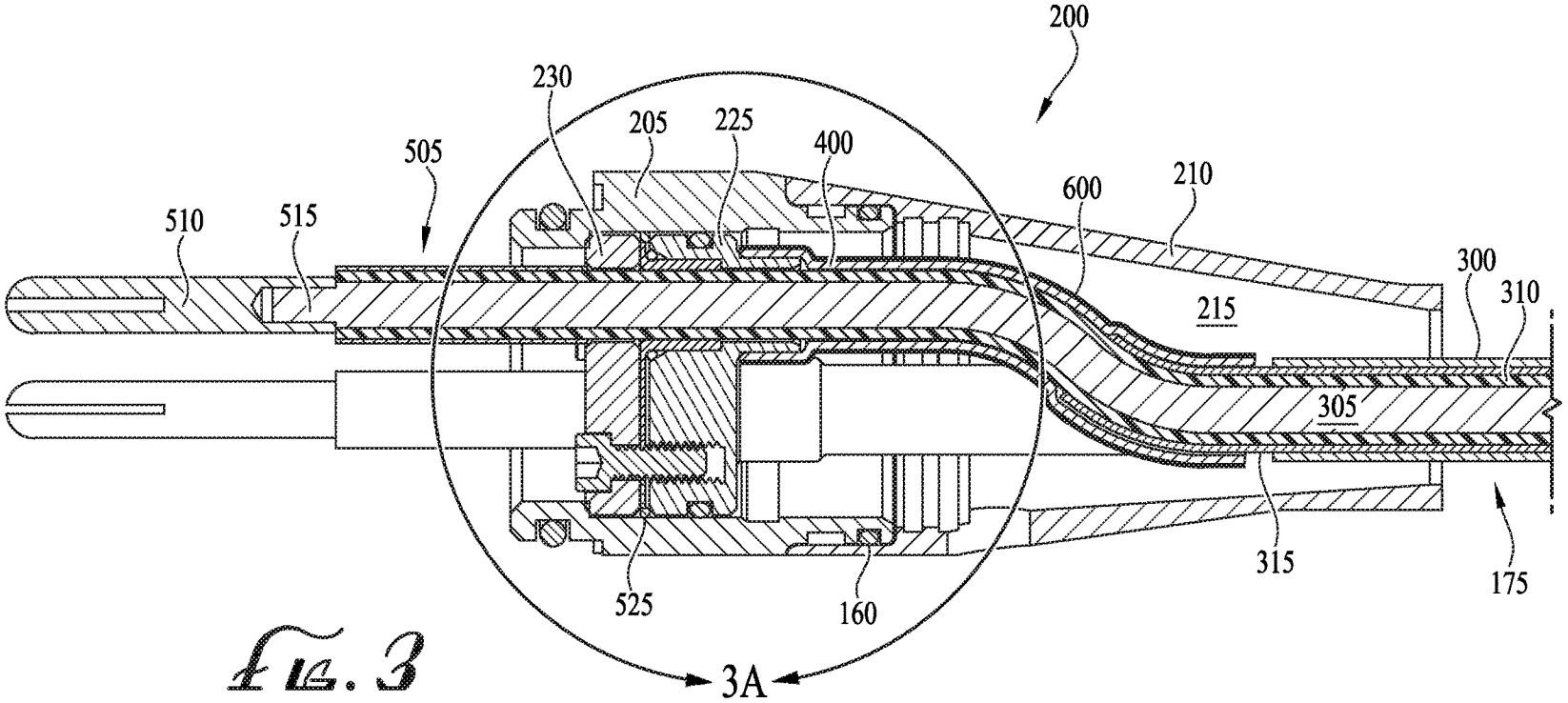
FIG. 3 is a cross-sectional view of a pothead of an illustrative embodiment.
Figure 3A:
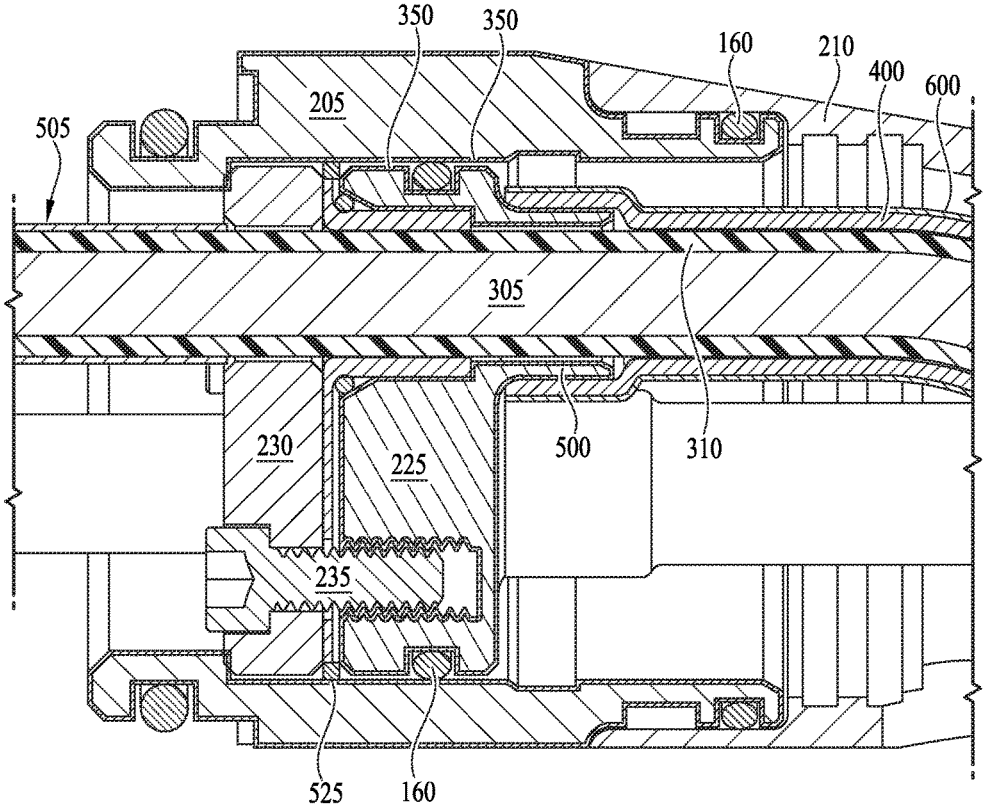
FIG. 3A is an enlarged view of the pothead of FIG. 3.
Figure 4:
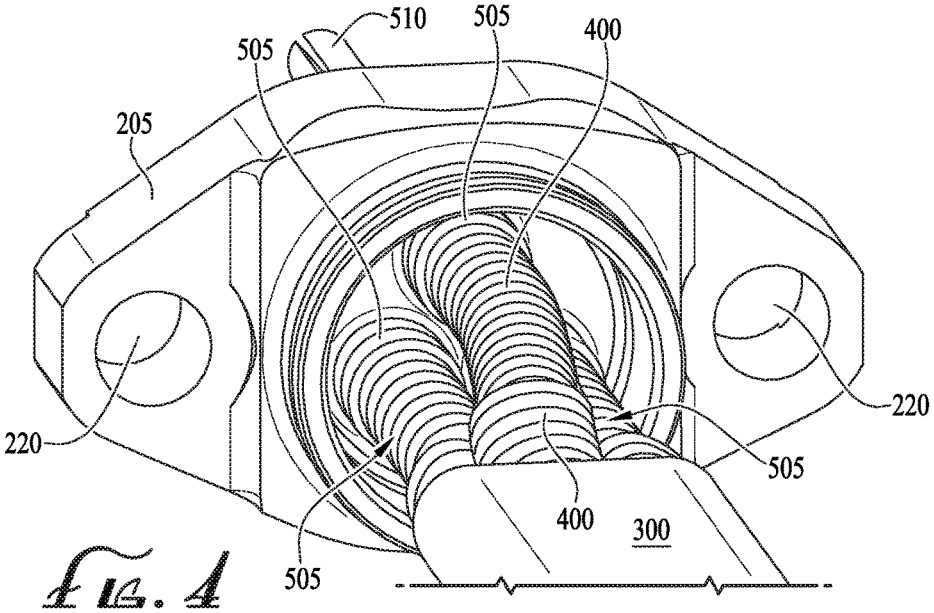
FIG. 4 is a perspective view of a motor lead extension (MLE) of an illustrative embodiment extending through an insulating block of an illustrative embodiment.

FIG. 2 illustrates a gas resistant pothead of illustrative embodiments. The housing of pothead 200 may include two hollow bodies, base 205 and cap 210. Base 205 may connect to motor head 180 on a bottom side and cap 210 on the top side of base 205 using screws 260 or another fastener known to those of skill in the art. Base 205 and cap 210 may be composed of and/or made of corrosion resistant steel and/or another corrosion resistant material, such as chromium, molybdenum, nickel, and/or nickel-copper alloy, hi some embodiment's base 205 and cap 210 may be a single body housing structure, rather than two pieces. Turning to FIG. 3 and FIG. 3A, cap 210 and base 205 of pothead 200 may generally be hollow and form an inner pothead cavity 215. Cap 210 may be sealed to base 205 with elastomeric ring 160. As shown in FIG. 3A, base 205 and/or the inner diameter of base 205 may include gold plating 350. Upper insulating block 225 may also include gold plating 350. Gold plating 350 may be fourteen karat gold plating, eighteen karat gold plating or another similar thin gold covering bonded to the inner diameter of base 205, the entire outer surface of base 205 and/or one or more outer surfaces of upper insulating block 225. As shown in FIG. 4, base 205 may include apertures 220 for bolts, screws or another similar fastening means to connect base 205 to head 180 of motor 135.

Returning to FIG. 3A, pothead 200 may include two insulator blocks, upper insulating block 225 and lower insulating block 230. Insulating blocks 225, 230 may be held together with fasteners 235, sealed to base with elastomeric ring 160 and/or secured inside hollow base 205 with encapsulant 520 (shown in FIG. 6). Upper insulating block 225 and lower insulator block 230 may be made of corrosion resistant steel and/or another corrosion resistant material, such as chromium, molybdenum, nickel, and/or nickel-copper alloy, and may be gold-plated with gold plating 350. Gold plating 350 may, for example be fourteen karat gold plating, eighteen karat gold, or a similar thin gold covering bonded to the outer surface of upper insulating block 225 and/or lower insulating block 230. In some embodiments, lower insulating block 230 and/or upper insulating block 205 may be made of a high temperature thermoplastic material, such as rubber or PEEK. In certain embodiments, only upper insulating block 225, and not lower insulating block 230, may include gold plating 350.

Figure 3B:
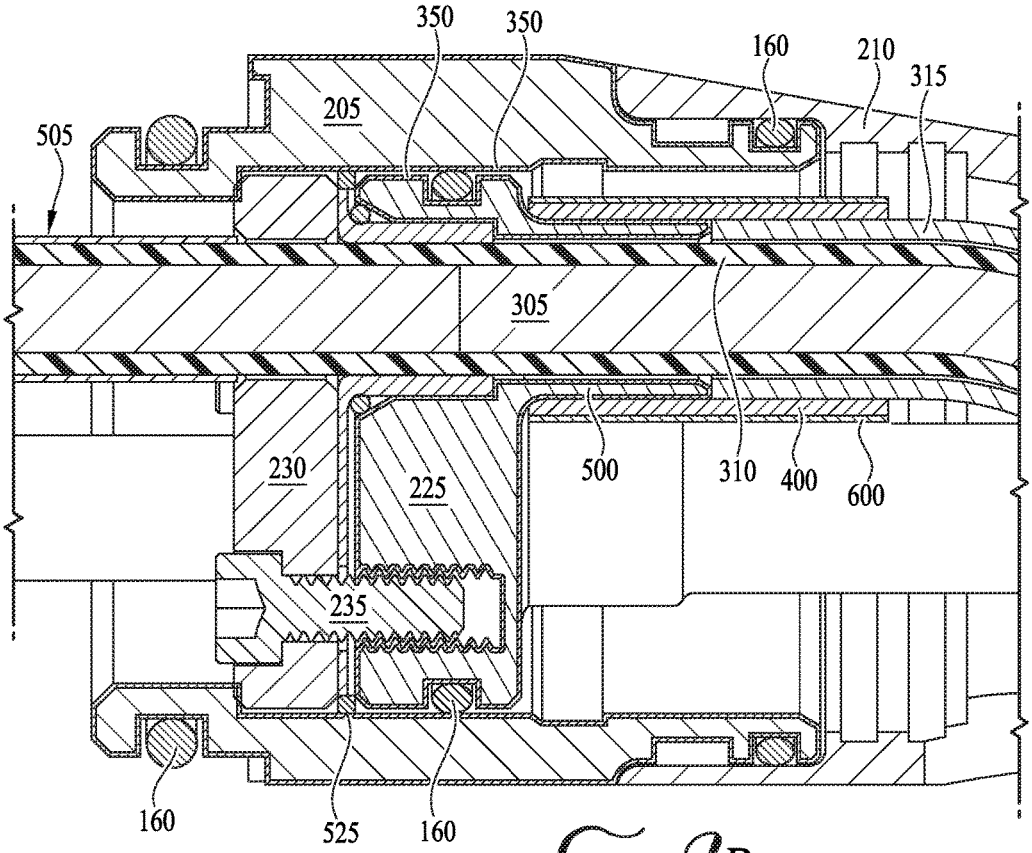
FIG. 3B is a cross-sectional view of a pothead of illustrative embodiments.
Figure 5:
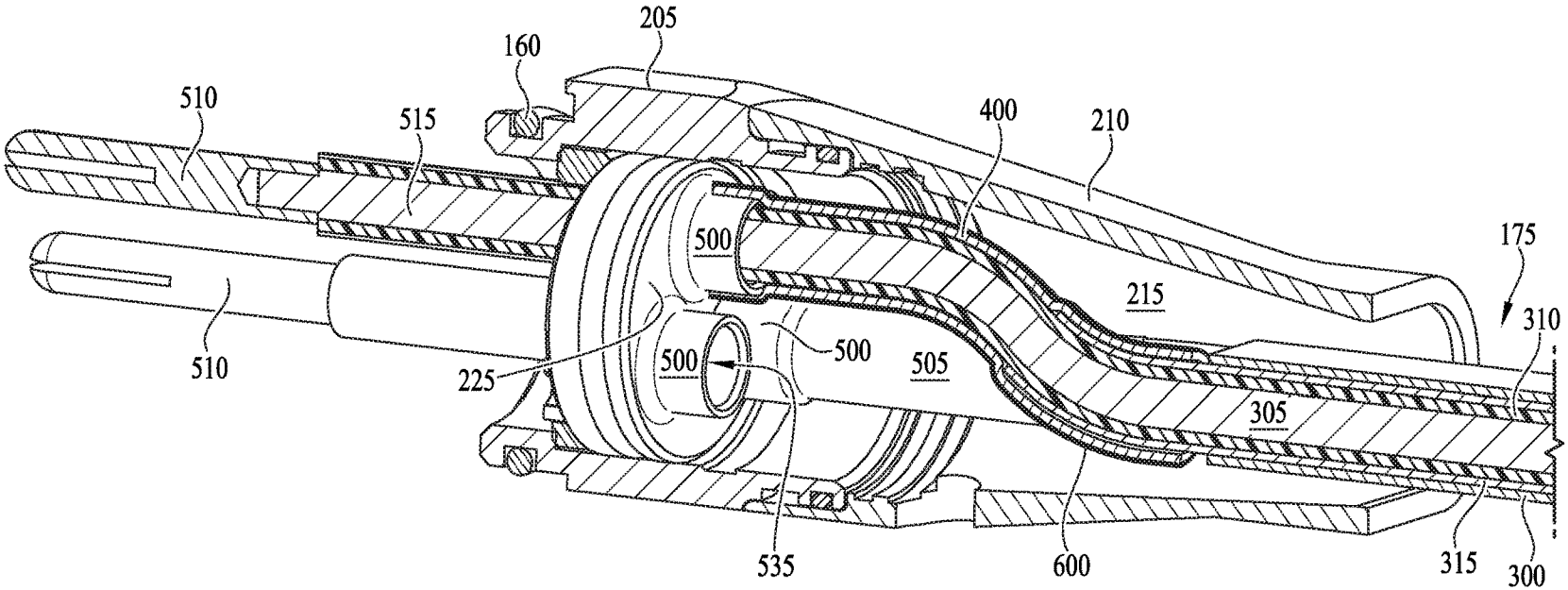
FIG. 5 is a perspective cross sectional view of a pothead of an illustrative embodiment.

As may best be seen in FIG. 5, upper insulating block 225 may include sleeves 500, one sleeve 500 for each phase 505 of MLE 175. Openings 535 through insulating block 225 may be formed inside each tubular sleeve 500, such that each phase 505 of MLE 175 extends through sleeve 500, through opening 535 in upper insulating block 225, through lower insulating block 230 and then connects to motor 135 and/or motor head 180. The outer diameter of sleeve 505 may include gold plating 350. In some embodiments, both the inner diameter and the outer diameter of sleeve 505 of upper insulating block may include gold plating 350, as shown in FIG. 3A. In some embodiments, sleeve may be lengthened upward and be about ¾ inch long, as shown in FIG. 3B.

Turning to FIG. 3, MLE 175 may extend from alongside ESP assembly 100 and through cavity 215 in pothead 200. Near, just inside and/or proximate the entrance to pothead 215, armor 300 around MLE 175 may terminate, permitting phases 505 to separate for connection to motor 135. Each MLE 175 may include three phases 505 for a three-phase, squirrel cage induction motor 135. MLE 175 and/or each phase 505 of MLE 175 may include inner conductor 305, with insulation layer 310 extending around conductor 305. Conductor 305 may be copper, aluminum or another similarly conductive material employed in power cables. Insulation layer 310 may for example be Ethylene Propylene Diene Monomer (EPDM), rubber, polypropylene or polyethylene. Insulation layer 310 may be at least partially surrounded by extruded lead sheath 315. Lead sheath 315 may protect MLE 175 as it extends the length of ESP assembly 100 downhole. In one example, lead sheath 315 may terminate about midway through pothead 200, prior to entry of MLE phases 505 entering sleeve 500. As shown in FIG. 3, lead sheath 315 terminates about midway inside pothead 200, where phase 505 curves to connect into upper insulator 225 sleeve 505. In another example, lead sheath 315 may extend along phase 505 until phase 505 reaches sleeve 500 at which point lead sheath 315 may terminate just prior to the entry of phase 505 into sleeve 500, as shown in FIG. 3B.

Conductor 305 of MLE 175 may extend through sleeve 500, through insulating bodies 225, 230 and connect to electrical connector 515 through conducting pins 510. Conducting pins 510 may extend out of electrical connector 515 and transfer current to motor 135 through corresponding electrical receptacles in the head of motor 135.

Figure 6:
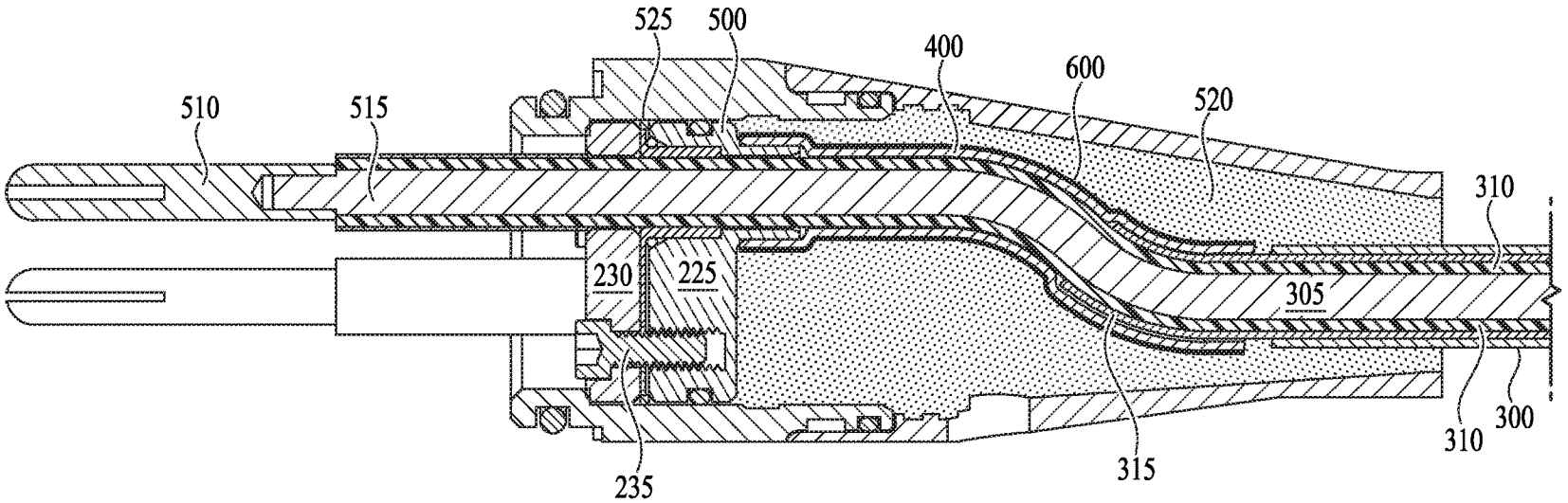
FIG. 6 is a cross sectional view of pothead of an illustrative embodiment.

A lead seal may protect the electrical connections inside pothead 200. The lead may seal by diffusion bonding to the gold-plated 350 components of pothead 200, such as gold plated base 205 and gold plated upper insulating block 225. Lead foil 400 may be wrapped around each phase 505 of MLE 175. Turning to FIG. 5 and FIG. 6, lead foil 400 wrapping may begin below termination of armor 300 and above termination of lead sheath 315, along MLE 175 and/or phase 505. Lead foil 400 may be wrapped around insulation layer 310 and/or lead sheath 315 around phase 505, until phase 505 enters sleeve 500. In the example of FIG. 3B, lead foil 400 may begin slightly above sleeve 500, such as an inch above sleeve 500 and/or extend above sleeve sufficiently to cover the interface between phase 505 and sleeve 500. Lead foil 400 may be a foil or tape about ½ inch or 1 inch wide, 0.030 inches thick, and may be available in 24 inch rolls. Lead foil 400 may have 99.98% pure lead and/or be at least 99% pure lead. Small amounts of copper or tin may be mixed with the lead in lead foil 400. Lead foil 400 may be wrapped around insulation layer 310 and/or lead sheath 315 in overlapping layers similar to a bandage wrapping. Lead foil 400 may also be wrapped around sleeve 500 of upper insulating block 225, such that lead foil 400 extends in a continuous layer from MLE 175 and/or phase 505 to sleeve 500 through which the phase 505 extends. Gold plating 350 and lead foil 400 within pothead 200 may allow a robust seal from downhole gas such as sour gas and/or carbon dioxide, in spaces that conventionally have been susceptible to gas permeation. As shown in FIG. 3A and FIG. 3B, stretched polytetrafluoroethylene (PTFE) splice tape 600 may be applied over lead foil 400. PTFE tape 600 may provide inward compression to lead foil 400. The inward compression may provide pressure for the layers of lead foil 400 to bond with each other and to the gold-plating 350 and/or metal of the insulating sleeve 500. PTFE tape 600 may be applied to all exposed lead foil 400.

Portions of base 205 and/or upper insulating block 225 may be gold plated 350 and/or the entire surfaces of base 205 and/or upper insulating block 225 may be gold plated 350. In some embodiments, only the inner diameter of base 205 and the outer diameter of upper insulating block 225 may be gold plated to allow bonding with lead foil 400. In certain embodiments, applying gold plating 350 to both the inner diameter and outer diameter of base 205 and upper insulating block 225 may be less labor intensive and less costly option. The gold plating 350 may be applied by electroplating gold or a gold-containing material onto the surface(s) of one or more parts of base 205, cap 215, upper insulating block 225 and/or lower insulating block 230. In an exemplary embodiment, base 205 may have gold plating with a thickness of 2.5 microns.

In an exemplary embodiment, lead foil 400 may be sheets of lead foil sold by the roll and made of 99% pure lead. In one example, the lead roll may be 1 inch wide include lead foil 400 that is 5 mm thick. The lead foil roll may be cut at varying lengths in order to control the area and shape of each lead foil 400 segment. Other illustrative embodiments may use rolls having different widths and with different thicknesses of lead foil. Lead foil 400 may be wrapped around MLE 175 with sections overlapping. For example, two overlapping layers of lead foil 400 segments may surround each MLE phase 505 with 50% of each segment's area overlapping. In other illustrative embodiments, a greater or smaller area of each segment may be overlapping, or more than two layers of lead foil 400 may be applied.

As shown in FIG. 6, the lead seal of illustrative embodiments may include encapsulant 520 filling cavity 215 and/or at least a portion of cavity 215 inside pothead 200, and around lead-wrapped phases 505 of MLE 175. Encapsulant 520 may fill the space inside cavity 215 between the outer diameter of MLE 175, lead foil 400 and/or PTFE tape 600 and the inner diameter of cap 210 and/or base 205, down to the top of upper insulating block 225. Encapsulant 520 may be inert to harmful gas and may mechanically reinforce lead foil 400 to combat the low hoop strength of lead foil 400. Cavity 215 may be filled with encapsulant 520 up to the sprue hole, which may prevent harmful gases from permeating pothead 200. Encapsulant 520 may be lead solder, epoxy, rubber, high temperature potable ceramic, high temperature thermoplastic solder or any other potable encapsulant inert to sour gas and carbon dioxide.

Lead gasket 525 may be included inside base 205 between upper insulating block 205 and lower insulator 230. Lead gasket 525 may bond to the gold plating of upper insulating block 205 and/or base 205, providing a metal seal between upper insulator 225 and base 205 and/or the housing of pothead 200. Lead gasket 525 may be a ring of lead that extends around the inner diameter of base 205, with a top side of lead gasket contacting upper insulating block 205.

Illustrative embodiments may provide a pothead connection that is resistant to permeation of damaging gas, such as $CO_2$ or $H_2S$ and/or reduce the likelihood of gas permeation through the pothead. Illustrative embodiments may protect the MLE's insulation layer 310, as well as the MLE's electrical conductors 305 inside a pothead motor connection 200 used with electric submersible motors 135. A lead seal may be formed by a lead foil 400 wrapped around the MLE 175, and the sleeve 500 of the insulating body 225. The insulating body 225 and/or the surfaces of the pothead housing 205, 210 may be gold plated 350. The lead may bond by diffusion to the gold, particularly in high temperatures such as 450° F., forming a seal to damaging gas which may prevent permeation of the gas through those sealed spaces. A lead gasket 525 placed inside the pothead housing adjacent to the bottom of the upper insulating body 225 may form a seal between the upper insulating body 225 and the pothead housing 205. Illustrative embodiments may be applied to existing components and may provide an improvement over conventional assemblies by allowing low installation and/or capital cost of the submersible motor components, while preventing and/or reducing gas-induced damage to electrical connections in the pothead, which may lengthen the operational lifetime of the submersible motor and/or ESP pump.

A gas resistant pothead system and method for electric submersible motors has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A gas resistant pothead system comprising:

a pothead for a motor lead extension (MLE) of an electric submersible motor power cable, the pothead comprising a pothead cavity above an insulator block, the insulator block being gold plated and comprising a gold-plated sleeve extending into the pothead cavity that is formed by a pothead base comprising a second gold plating and coupled below a pothead cap;

a lead gasket secured around an inner diameter of the pothead base, the lead gasket bonded to the gold plating on the insulator block and the second gold plating on the pothead base;

the MLE extending through the pothead cavity and the gold-plated sleeve of the insulator block; and a lead seal inside the pothead cavity, and comprising:

lead foil wrapped around the gold-plated sleeve of the insulator block and around the MLE inside the pothead cavity, the lead foil diffusion bonded to the gold plating on the sleeve of the insulator block; and an encapsulant within the pothead cavity surrounding the lead foil wrapped MLE.

2. The gas resistant pothead system of claim 1, wherein the lead foil wraps around the MLE from above a termination point of an MLE sheath to an intersection of the MLE with the insulator block.

3. The gas resistant pothead system of claim 2, wherein the lead foil continues to wrap around the gold-plated sleeve of the insulator block below the intersection of the MLE with the insulator block.

4. The gas resistant pothead system of claim 1, wherein the MLE comprises:

an inner copper conductor;

an insulation layer around the inner copper conductor;

an extruded lead sheath around the insulation layer, the extruded lead sheath terminating inside the pothead cavity; and armor around the extruded lead sheath, the armor terminating inside the pothead cavity above termination of the extruded lead sheath.

5. The gas resistant pothead system of claim 4, wherein the lead foil wraps around the extruded lead sheath and then continues around the gold-plated sleeve of the insulator block.

6. The gas resistant pothead system of claim 1, further comprising a gold-plated housing surrounding the insulator block, the gold-plated housing forming the pothead cavity.

7. A system comprising:

a pothead electrically coupling a motor lead extension (MLE) to an electric submersible motor, the pothead comprising:

a hollow gold-plated base;

a hollow cap coupled above the gold-plated base;

an insulator block comprising gold plating and at least one gold plated sleeve, the insulator block inside the gold-plated hollow base;

a lead gasket extending around an inner diameter of the gold-plated hollow base below the insulator block, the lead gasket bonded to the gold plating of the hollow base and the gold plating of the insulator block;

the MLE comprising at least one MLE phase extending through a cavity of the hollow cap and through the at least one gold plated sleeve of the gold-plated insulator block, the MLE comprising a lead sheath that terminates inside the hollow cap;

lead foil wrapped around a portion of an outer surface of each of the at least one MLE phase, the lead foil wrapped portion extending between the termination of the lead sheath and an MLE phase entrance to the gold-plated sleeve;

the lead foil wrap continuing around and diffusion bonded to the gold-plated sleeve; and encapsulant filling the cavity of the hollow cap and reinforceably surrounding the lead foil wrapped portion of the at least one MLE phase.

8. The system of claim 7, where each of the at least one MLE phase comprises:

a copper conductor;

an insulation layer around the copper conductor; and an extruded lead sheath around the insulation layer;

wherein the lead foil wraps around one of the insulation layer, the extruded lead sheath or a combination thereof.

9. The system of claim 8, wherein polytetrafluoroethylene (PTFE) tape wraps around the lead foil wrap.

10. The system of claim 7, wherein the insulator block is corrosion resistant steel and the gold plating is plated over the corrosion resistant steel.

11. The system of claim 7, wherein the lead gasket is sandwiched between the insulator block and a second insulator block positioned below the insulator block.

12. The system of claim 7, wherein the electric submersible motor is a two-pole, three-phase squirrel cage induction motor operatively coupled to a multi-stage centrifugal pump.

* * * * *